US007132983B2

(12) United States Patent
Gaier

(10) Patent No.: US 7,132,983 B2
(45) Date of Patent: Nov. 7, 2006

(54) HIGH FREQUENCY SIGNAL TRANSMITTER WITH VERTICALLY SPACED COUPLING AND RADIATING ELEMENTS

(75) Inventor: Stefan Gaier, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 83 days.

(21) Appl. No.: 10/495,683

(22) PCT Filed: Jun. 17, 2003

(86) PCT No.: PCT/DE03/02002

§ 371 (c)(1),
(2), (4) Date: May 14, 2004

(87) PCT Pub. No.: WO2004/030150

PCT Pub. Date: Apr. 8, 2004

(65) Prior Publication Data

US 2005/0077985 A1 Apr. 14, 2005

(30) Foreign Application Priority Data

Sep. 19, 2002 (DE) ..... 102 43 506

(51) Int. Cl.
*H01Q 1/38* (2006.01)

(52) U.S. Cl. ..... 343/700 MS; 333/33

(58) Field of Classification Search ..... 343/700 MS; 333/33, 247

See application file for complete search history.

(56) References Cited

U.S. PATENT DOCUMENTS 5,057,798 A 10/1991 Moye
5,229,727 A 7/1993 Clark
5,689,216 A 11/1997 Sturdivant
5,903,239 A * 5/1999 Takahashi et al. ... 343/700 MS
6,057,600 A * 5/2000 Kitazawa et al. ..... 257/728
6,320,543 B1 * 11/2001 Ohata et al. ..... 343/700 MS

FOREIGN PATENT DOCUMENTS

DE 43 15 847 11/1994

(Continued)

OTHER PUBLICATIONS

Naftali I. Herscovici et al: "Cad of Multilayer Feeding Networks" 176 Microwave Journal, 37 (1994) Jun., No. 6, pp. 86-88, 92-96 (In English).

(Continued)

*Primary Examiner*—Benny T. Lee
(74) *Attorney, Agent, or Firm*—Michael J. Striker

(57) ABSTRACT

The current invention provides a high-frequency signal transmitter with: a first strip line (10) on the surface of a dielectric substrate (11) for producing a signal; a second strip line (16) in the dielectric substrate (11) for the coupling-out and/or coupling-in of a high-frequency signal; a first interfacial connection device (15) in the substrate (11) for producing a conductive connection between the first and second strip line (10; 16); a first solid surface (12) essentially parallel to the microstrip line (10) and serving as a lower boundary surface of the substrate (11) in the vertical direction for producing a shielding; a second solid surface (18) essentially parallel to the first solid surface (12) and disposed at least in the region above the second strip line (16) on the substrate (11) for producing a shielding; a coupling opening (17) in the second solid surface (18) for radiating high-frequency energy; a planar coupling device (19) above and essentially parallel to the coupling opening (17); and a second interfacial connection device (20) between the first solid surface (12) and the second solid surface (18), in the region adjacent to the first interfacial connection device (15).

10 Claims, 2 Drawing Sheets

FOREIGN PATENT DOCUMENTS

WO 00/46921 8/2000

OTHER PUBLICATIONS

J. R. Sanford et al: "Optimized Antennas for Mobile Communication..."Proceedings of the 21st European Microwave Conference, Stuttgart Sep. 9-12, 1991, pp. 780-786 (In English).

Gildas P. Gauthier et al: "A 94-GHz Perture-Coupled..." IEEE, vol. 47, No. 12, Dec. 1999, pp. 1761-1765 (In English).

Simons R. N., et al: "Coplanar0Waveguide/Microstrip..." Electronics Letters, IEE Stevenage, GB, BD. 26, NR. 24, Nov. 22, 1990, pp. 1998-2000 (In English).

* cited by examiner

HIGH FREQUENCY SIGNAL TRANSMITTER WITH VERTICALLY SPACED COUPLING AND RADIATING ELEMENTS

BACKGROUND OF THE INVENTION

The current invention relates to a high-frequency signal transmitter and in particular, to a high-frequency signal transmitter with a strip line-to-coplanar transition.

A known method for transmitting high-frequency signals, e.g. in microwave engineering, is to use aperture-coupled patch antennae. These are employed in antenna arrays, i.e. antenna arrangements with several of these patch antennae, or as individual emitters and/or couplers.

FIG. 4 shows a conventional aperture- or slot-coupled patch antenna. In FIG. 4, an antenna patch 19 is excited via a coupling slot 17 in a solid surface 18, the coupling slot 17 in turn being supplied by means of a supply line 16 with a free end 16 embedded in a buried plane. Underneath this plane 16 is another solid surface 12, that is connect in an electrically conductive fashion via interfacial connections 20 to the solid surface 18 provided with the coupling opening 17. A design of this kind is distinguished by a high transmission bandwidth. Between the supply line 16 and the coupling slot, there is usually a substrate b provided, in which the high-frequency energy of the signal to be transmitted or coupled into is linked to the slot or to the coupling opening 17. In microwave antenna arrangements or connections of this kind, the supply line 16 embedded in the substrate is usually provided in the form of a strip line. The HF energy of the signal is conveyed between the strip line 16 in the substrate and a solid surface 12, 18 on the top and bottom of the substrate.

But radiating the HF energy outward, e.g. into the air, from a substrate, is problematic, particularly when doing so from a substrate that has a high dielectric constant. For example, if low temperature cofired ceramic (LTCC)—which is suitable as a base material for microwave circuits—is used as the substrate material, then it becomes necessary to address the problem mentioned above since LTCC has a quite high dielectric constant of $\in_r>4$. This results in a reduction in antenna gain as well as a deterioration in antenna efficiency.

SUMMARY OF THE INVENTION

The high-frequency signal transmitter according to the invention, has the advantage over the known approach that the HF energy of the signal is concentrated in the region of the coupling slot of the transmitter or antenna and there is an increase in the antenna efficiency and antenna gain.

The idea underlying the current invention is essentially comprised in changing over from a supply line produced using microstrip technology to a coplanar line via a microstrip-to-coplanar transition, the coplanar line being connected by means of an interfacial connection to the actual antenna supply line embedded in a substrate. This concentrates the signal energy in the vicinity of the coupling opening of the antenna, which makes it possible to achieve an efficiency that is higher than if the microstrip line were to be directly connected to the supply line embedded in the substrate by means of an interfacial connection.

In other words, in order to improve the efficiency of the high-frequency signal transmitter according to the current invention, it is provided with a device with a first strip line, on the surface of a dielectric substrate, for producing a signal, a second strip line in the dielectric substrate for the coupling-out and/or coupling-in of a high-frequency signal, a first interfacial connection device in the substrate for producing a conductive connection between the first and second strip line, a first solid surface essentially parallel to the microstrip line and serving as a lower boundary surface of the substrate in the vertical direction for producing a shielding; a second solid surface essentially parallel to the first solid surface disposed at least in the region above the second strip line on the substrate for producing a shielding, a coupling opening in the second solid surface for radiating high-frequency energy, a planar coupling device above and essentially parallel to the coupling opening, and a second interfacial connection device between the first solid surface and the second solid surface, in the vicinity of the first interfacial connection device.

According to a preferred modification, the substrate contains a ceramic material, preferably low temperature cofired ceramic (LTCC). Ceramic substrates and especially those made of LTCC have the advantage of possessing favorable high-frequency properties.

According to another preferred modification, the substrate has a high dielectric constant, in particular one greater than 4. This permits the selection of advantageous substrate materials.

According to another preferred modification, the second interfacial connection device has a number of discrete interfacial connection elements. This has the advantage of assuring the most homogeneous and uniform field transition possible in the transition region between the microstrip line and the coplanar line from the lower, first solid surface to the upper, second solid surface.

According to another preferred modification, the first strip line transitions into a coplanar line in the vicinity of the first interfacial connection. This is advantageous since in this way, in connection with the two features mentioned above, a majority of the HF energy is no longer conveyed only between the strip line and the lower, first solid surface and consequently can be better coupled out from the substrate in comparison to a device in which the supplying microstrip line is connected to the line embedded in the substrate merely by means of an interfacial connection.

According to another preferred modification, the first strip line transitions into a coplanar line in the vicinity of the first interfacial connection. This is advantageous since in this way, in connection with the two features mentioned above, a majority of the HF energy is no longer conveyed only between the strip line and the lower, first solid surface and consequently, can be better coupled out from the substrate in comparison to a device in which the supplying microstrip line is connected to the line embedded in the substrate merely by means of an interfacial connection (via).

According to another preferred modification, the second strip line is spaced a smaller distance away from the second solid surface than it is from the first solid surface. This brings to the given antenna arrangement the advantages of an asymmetrical strip line.

According to another preferred modification, one end of the second strip line in the longitudinal direction is spaced apart from the coupling opening by approximately one fourth the wavelength of the useful signal wave on the strip line. This advantageously optimizes the coupling-out of the high-frequency signal through the coupling opening.

BRIEF DESCRIPTION OF THE DRAWINGS

Exemplary embodiments of the invention are shown in the drawings and will be explained in detail in the subsequent description.

DETAILED DESCRIPTION OF THE PREFERRED EMBODIMENTS

Figure 1:
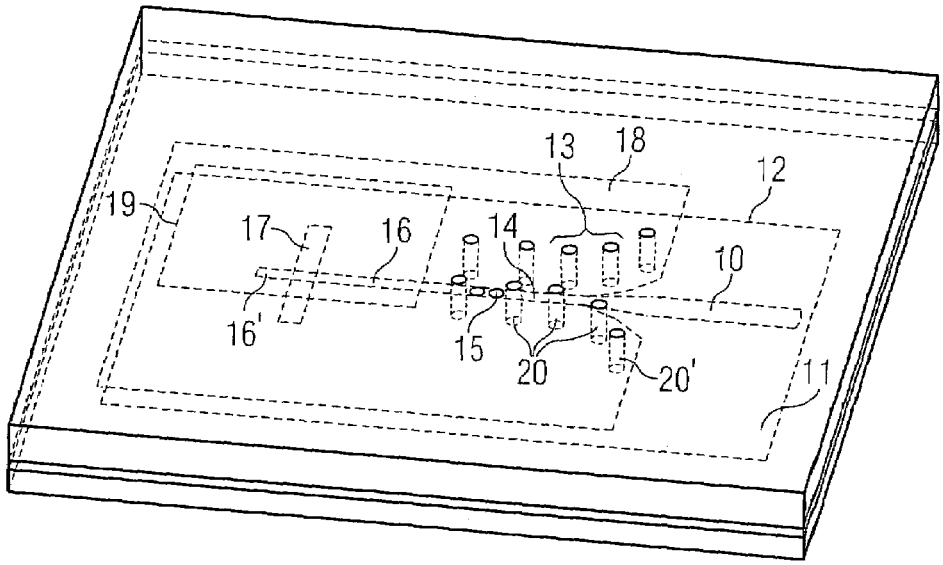
FIG. 1 is a schematic oblique view to illustrate an embodiment of the high-frequency signal transmitter according to the invention.

Components that are the same or function in the same manner are provided with the same reference numerals in the figures and may not be described in detail for each one of the figures.

FIG. 1 is a schematic oblique view to illustrate an embodiment of the high-frequency signal transmitter according to the invention.

In FIG. 1, a first microstrip line 10 is shown, which is disposed on a dielectric substrate 11, preferably comprised of a ceramic material such as low temperature cofired ceramic (LTCC). Viewed in the vertical direction, a first solid surface 12 preferably constitutes a lower boundary plane of the dielectric substrate 11 and is electrically conductive, preferably comprised of a metal. In a transition region 13 from the strip line 10 to a coplanar line 14 on the surface of the substrate 11, the supply line 10, 14 undergoes a structural change.

The coplanar line 14 is connected by means of a first interfacial connection device 15 to a second strip line 16, which is embedded in the substrate 11. The embedded strip line 16 preferably extends parallel to the first strip line and likewise parallel to the first solid surface 12. The interfacial connection device 15 between the coplanar line 14 and the embedded strip line 16 is electrically conductive and preferably contains a metal; this interfacial connection device 15 preferably extends perpendicularly to the coplanar line 14 and the strip line 16. The free end 16' of the embedded strip line 16 is disposed in the vicinity of a coupling opening 17 or coupling slot, which is disposed in a second solid surface 18 on the surface of the substrate 11, essentially parallel to the first solid surface 12. Above the coupling opening 17, essentially parallel to the second solid surface 18, a coupling device is provided, preferably an antenna patch element 19, which is electromagnetically coupled to the embedded line 16 via the coupling opening 17. The coupling slot 17 is aligned perpendicular to the line 16 in a cross-like fashion, above which the preferably rectangular patch element extends with its edges aligned parallel to this cross.

The second solid surface 18 is connected to the first solid surface 12 in an electrically conductive fashion by means of an interfacial connection device 20 that is preferably comprised of a number of discrete interfacial connection elements 20'. The second solid surface 18 preferably extends in the longitudinal direction parallel to the strip line 10, 16 beyond the span of the patch antenna element 19 and in the other direction, beyond the transition region 13 between the strip line 10 and the coplanar line 14. In the vicinity of this transition 13, the second solid surface 18 has a preferably funnel-shaped indentation or a funnel-shaped recess and encompasses the transition 13, the coplanar line 14, and the region of the interfacial connection 15, without electrically contacting the respective devices.

The discrete interfacial connection elements 20' between the first solid surface 12 and the second solid surface 18 are preferably also arranged in a funnel-shaped pattern, which approximately corresponds to the form of the funnel-shaped indentation in the second solid surface 18. For example, a discrete contacting element 20' is round and cylindrical and is provided extending perpendicularly between the first solid surface 12 and the second solid surface 18. In addition, the interfacial connection device 20 between the solid surfaces 12, 18 is preferably mirror symmetrical to an imaginary plane of reflection extending through the center of the strip line 10 and the coplanar line 14. It would also be conceivable to provide a continuous, electrically conductive wall as a contacting device 20 between the solid surfaces 12 and 18, which wall could extend, for example, along the contacting elements 20' for which it would then substitute.

Figure 2:
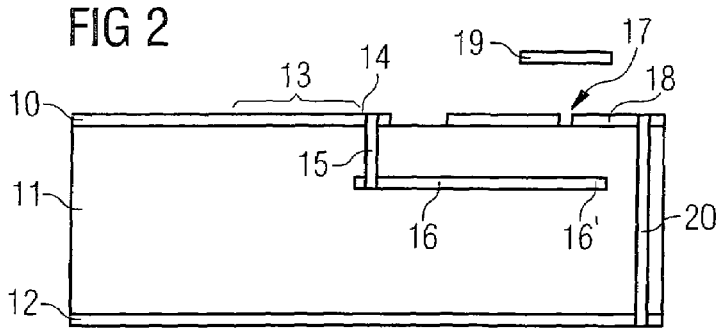
FIG. 2 is a schematic longitudinal section to illustrate the embodiment according to FIG. 1.

FIG. 2 is a schematic longitudinal section to illustrate the embodiment according to FIG. 1.

FIG. 2 shows a longitudinal section along the center of the strip line 10 and the coplanar line 14. A strip line 10 is provided on the substrate 11 and transitions in a transition region 13 to the coplanar line 14. This coplanar line 14 is connected via an electrically conductive interfacial connection 15 to a strip line 16 that is embedded in the substrate 11 and extends parallel to the strip line 10 and parallel to a first solid surface 12. The coplanar line 14 ends and the strip line 16 begins in the vicinity of the interfacial connection device 15 between the coplanar line 14 and the strip line 16. At the other end section 16' of the strip line 16, a second solid surface 18 with a coupling opening 17 is disposed on the surface of the substrate 11 in the same plane as the first strip line 10.

The distance between the coupling opening 17 and the end 16' of the embedded strip line 16 in the longitudinal direction, i.e. viewed in the direction of the strip line 16, is preferably approximately one fourth the wavelength of high-frequency signal to be transmitted via the strip line 10, coplanar line 14, interfacial connection device 15 and strip line 16. At a distance of $\lambda/4$ of the signal wavelength between the end 16' of the strip line 16 and the opening 17 in the solid surface 18, a maximal coupling occurs as well as a maximal excitation of the planar emitter 19 or the coupling device.

The interfacial connection device 20 between the first solid surface 12 and the second solid surface 18 is only shown by way of example in FIG. 2 in order to demonstrate an existing connection between the two surfaces 18 and 12 (a correspondence to a comparable location in FIG. 1 is not shown). Although the first solid surface 12 appears to establish a boundary of the substrate 11 toward the bottom, i.e. in the vertical direction, it is entirely possible for the substrate 11 to also continue on below the solid surface 12 and for the whole design or structure to be multi-layered.

Figure 3:
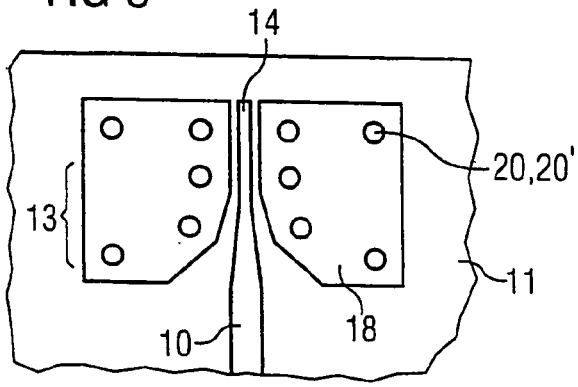
FIG. 3 is a schematic detail viewed from above to illustrate the embodiment of the current invention according to FIG. 1 and FIG. 2.
Figure 4:
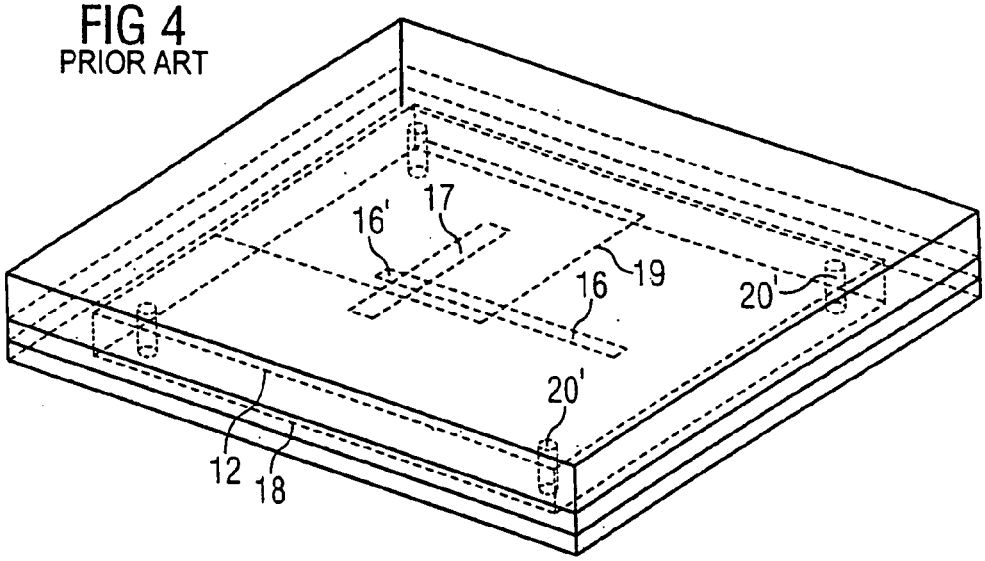
FIG 4 PRIOR ART
FIG. 4 is a schematic oblique view of a conventional high-frequency signal transmitter.

FIG. 3 is a schematic detail viewed from above to illustrate the embodiment of the current invention according to FIG. 1 and FIG. 2.

FIG. 3 primarily shows the transition 13 from the strip line 10 on the surface of the substrate into the coplanar line 14 on the surface of the substrate 11. This transition 13, which preferably extends conically, is preferably provided in a funnel-shaped slot or a funnel-shaped recess in the second solid surface 18, which is connected to the first solid surface 12, not shown in FIG. 3, via the interfacial connection device 20 or the discrete interfacial connection elements 20'. The interfacial connection elements 20', which are preferably disposed mirror-symmetrical to the coplanar line and strip line 10, are also arranged in a funnel-shaped pattern.

If a change from a microstrip line 10 to a coplanar line 14 by means of the transition 13 occurs in the manner shown in FIGS. 1 to 3 before the interfacial connection 15 into the embedded plane 16, then the HF energy is conveyed predominantly in the slot of the coplanar line 14. As a result, after the interfacial connection 15 into the embedded line 16, with the asymmetrical strip line used here, the HF energy is conveyed chiefly between the upper solid surface 18 (with the coupling slot 17) and the embedded line 16. Consequently, the HF energy can be more easily coupled out through the coupling slot 17 and there is an increase in the antenna efficiency and antenna gain. The interposition of the coplanar transition 10, 13, 14 improves the functioning of the antenna primarily because the reference mass for the HF signal can extend from the lower solid surface 12 to the upper solid surface 18 without a discontinuous transition. This prevents the HF energy from remaining in the substrate 11 and being impossible to radiate.

Although the current invention has been explained above in conjunction with preferred exemplary embodiments, it is not limited to these, but can be modified in numerous ways.

In particular, materials such as the ceramic substrate material LTCC should be viewed as mere examples. Moreover, the above-mentioned funnel-shape of the recess in the second solid surface in the vicinity of the transition between the strip line and the coplanar line should also be viewed as an example; it is also conceivable to provide a transition that is round when viewed from above.

The invention claimed is:

1. A high-frequency signal transmitter with:

a first strip line (10) on a surface of a dielectric substrate (11) for providing a signal;

a second strip line (16) vertically spaced from the first strip line and located within the dielectric substrate (11) for the coupling-out and/or coupling-in of a high-frequency signal;

a first interfacial connection device (15) in the substrate (11) for providing a vertical conductive connection between the first and second strip line (10; 16);

a transition region (13), wherein in the transition region (13), the first strip line (10) transitions into a coplanar line (14) before the first interfacial connection (15);

a first solid surface (12) essentially parallel to the first strip line (10) and serving as a lower boundary surface of the substrate (11) providing a shielding;

a second solid surface (18) essentially parallel to the first solid surface (12) and disposed at least in the region above the second strip line (16) on the surface of the substrate (11) for providing a shielding;

a coupling opening (17) in the second solid surface (18) for radiating high-frequency energy;

a planar coupling device (19) above and essentially parallel to the coupling opening (17); and a second interfacial connection device (20) between the first solid surface (12) and the second solid surface (18), in the region adjacent to the transition region (13).

2. The device according to claim 1, wherein the substrate (11) contains a ceramic material.

3. The device according to claim 2, wherein the ceramic material is low temperature cofired ceramic (LTCC).

4. The device according to claim 1, wherein one end (16') of the second strip line (16) extends past the coupling opening (17) by approximately one fourth the wavelength of the useful signal wave on the strip line.

5. The device according to claim 1, wherein the second interfacial connection device (20) has a number of discrete interfacial connection elements (20').

6. The device according to claim 5, wherein the discrete interfacial connection elements (20') in the vicinity of the transition region are arranged in a funnel-shaped pattern along the transition region wherein the second solid surface (18) becomes a funnel-shaped recess at the transition region.

7. The device according to claim 1, wherein adjacent to the first interfacial connection (15), the first strip line (10) is encompassed by the second solid surface (18), in a non-contacting manner to define said coplanar line.

8. The device according to claim 1, wherein the second strip line (16) is spaced a smaller distance away from the second solid surface (18) than from the first solid surface (12).

9. The device according to claim 1, wherein the substrate (11) has a high dielectric constant.

10. The device according to claim 9, wherein the high dielectric constant is greater than 4.

* * * * *